US008590592B2

(12) United States Patent
Kim

(10) Patent No.: US 8,590,592 B2
(45) Date of Patent: Nov. 26, 2013

(54) ROLL BLIND HAVING NOISELESS BIDIRECTIONAL CLUTCH

(76) Inventor: Jung-Min Kim, Yangju-si (KR)

( * ) Notice: Subject to any disclaimer, the term of this patent is extended or adjusted under 35 U.S.C. 154(b) by 0 days.

(21) Appl. No.: 13/509,624

(22) PCT Filed: Mar. 30, 2012

(86) PCT No.: PCT/KR2012/002425

§ 371 (c)(1),
(2), (4) Date: May 14, 2012

(87) PCT Pub. No.: WO2013/077502

PCT Pub. Date: May 30, 2013

(65) Prior Publication Data

US 2013/0255894 A1 Oct. 3, 2013

(30) Foreign Application Priority Data

Nov. 22, 2011 (KR) ..... 10-2011-0122135

(51) Int. Cl.
*E06B 9/78* (2006.01)

(52) U.S. Cl.
USPC ..... 160/320; 160/323.1

(58) Field of Classification Search
USPC ..... 160/319, 320, 321, 323.1, 297, 170; 192/41 S
See application file for complete search history.

(56) References Cited

U.S. PATENT DOCUMENTS 4,372,432 A * 2/1983 Waine et al. ..... 192/223.4
4,865,109 A * 9/1989 Sherman ..... 160/321
5,443,109 A * 8/1995 Benthin ..... 160/298
5,488,983 A * 2/1996 Jung ..... 160/298
5,586,631 A 12/1996 Benthin
5,634,244 A * 6/1997 Fetsch et al. ..... 24/115 F
5,791,393 A * 8/1998 Judkins ..... 160/321
6,129,131 A * 10/2000 Colson ..... 160/84.02
6,142,211 A * 11/2000 Judkins ..... 160/308
6,685,592 B2 * 2/2004 Fraczek et al. ..... 475/14
7,128,126 B2 * 10/2006 Smith et al. ..... 160/319
7,665,507 B2 * 2/2010 Naoki ..... 160/308

FOREIGN PATENT DOCUMENTS

JP 1984-195985 11/1984
JP 2010-090618 4/2010
KR 102003979160 12/2003
KR 1020060095472 8/2006
KR 1020110038745 4/2011

OTHER PUBLICATIONS

Korean Office Action, Jan. 26, 2013.

* cited by examiner

*Primary Examiner* — David Purol
(74) *Attorney, Agent, or Firm* — Nathan & Associates Patent Agents Ltd.; Menachem Nathan

(57) ABSTRACT

A roll blind includes: a safety cord connected to and wound around a chain pulley adapted to rotate the winding rod, the safety cord having a separated lower end so that one side defines a lowering cord for pulling down the blind material and the other side defines a raising cord for rolling up the blind material; a bidirectional clutch unit adapted to raise/lower the blind material, the bidirectional clutch unit being positioned between the chain pulley and a driving shaft of the winding rod, the bidirectional clutch unit having bidirectional protrusions formed on an inner peripheral surface of the chain pulley at an identical interval in a circumferential direction so that, when the lowering or raising cord is pulled, the winding rod rotates together with the chain pulley, the bidirectional clutch unit having a number of rollers positioned between respective bidirectional protrusions.

7 Claims, 7 Drawing Sheets

ROLL BLIND HAVING NOISELESS BIDIRECTIONAL CLUTCH

TECHNICAL FIELD

The present invention relates to a roll blind apparatus adapted to block sunlight coming through a window and avoid exposure of indoor privacy, and more particularly, to a roll blind having a noiseless bidirectional clutch, the blind including a pulling cord for raising/lowering the blind material, the lower end of the pulling cord being separated and used as lowering and raising cords, respectively, the clutch being able to rotate freely in either direction without generating operational noise so that, once one of the lowering and raising cords is pulled downwards, an operation to return it to the original position is automatically and smoothly conducted, thereby enabling the user to easily and continuously raise/lower the blind material.

BACKGROUND ART

In general, roll blinds are installed on windows of various buildings to block external light, adjust indoor lighting, or avoid exposure of indoor privacy.

Such a roll blind typically has a single piece of blind material or a plurality of slats, which are installed in the horizontal direction, and which are rolled up around the overlying winding rod to be stored, or rolled down from the winding rod to cover the window.

FIG. 1 shows an exemplary conventional roll blind 1.

The conventional roll blind 1 includes a frame 10 attached to a wall, etc.; driving and driven brackets 12 and 14 installed on both sides of the frame 10, respectively; a winding rod 20 rotatably mounted between the brackets 12 and 14 in the form of a pipe; a blind material 30 wound around the winding rod 20; and a weight 40 fixed to the bottom of the blind material 30 to roll down and unwind the blind material 30 from the winding rod 20 by its own weight.

The driving bracket 12 contains a chain pulley 50 integrally connected to the winding rod 20 and rotated accordingly. A pulling cord 60 is wound around the chain pulley 50 so that pulling of one side of the pulling cord 60 rotates, through the chain pulley 50, the winding rod 20, which then winds up the blind material 30.

On the other hand, pulling of the other side of the pulling cord 60 rotates the chain pulley 50 and thus the winding rod 20 in the opposite direction so that the blind material 30 is unwound from the winding rod 20 and lowered.

The pulling cord 60, which is operated by the user to roll up or down the blind material 30, is a type of continuous track that is wound around the chain pulley 50. The lower end of the pulling cord 60, as shown in FIG. 1, hangs down a considerable length and may cause a very dangerous situation.

For example, a child may hide behind the blind material 30, which hangs down, during hide-and-seek, and the continuous track-type pulling cord 60 may be accidently wound around the child's neck.

In such a case, the pulling cord 60 could turn very fatal when wound around a child's neck, and there has even been reports that, if a child falls over with such a pulling cord 60 wound around the neck, he/she may be easily choked.

Such a conventional continuous track-type pulling cord 60 of a roll blind 1 is dangerous not only to children, as mentioned above, but also to elderly people, who may stumble on the cord and fall over.

It is necessary, in order to solve the above-mentioned problems, that the pulling cord 60 be not continuous, as in the case of the conventional continuous track type, and the pulling cord 60 be positioned high enough to prevent children from reaching it or elderly people from stumbling on it.

However, conventional technology has a limitation in that, if the lower end of the pulling cord 60 of a roll blind 1 is separated to reduce its length, and if it is positioned high enough to prevent children from reaching it, it becomes impossible to raise/lower the blind material 30 as desired. This necessitates new technology to tackle this issue.

Furthermore, some conventional roll blinds generate unpleasant noise (e.g. tinkling or rattling) when the clutch is operated to raise/lower the blind material 30, which compromises the quietness of indoor environment. This is another problem to be solved.

DISCLOSURE

Technical Problem

Therefore, the present invention has been made in view of the above-mentioned problems, and an aspect of the present invention is to provide a roll blind having a pulling cord for raising/lowering the blind material, the lower end of the pulling cord being separated to reduce its length so that, even if the blind is positioned high beyond the reach of children, the blind material can be raised/lowered smoothly, thereby preventing any negligent accident (e.g. the cord being wound around the neck of a child) during use of the blind.

Another aspect of the present invention is to provide a roll blind configured in such a manner that, once either the lowering or raising cord is pulled down through the bidirectional clutch, the cord returns smoothly to the original position, thereby guaranteeing that the user can easily use the lowering or raising cord to continuously raise/lower the blind material in a convenient manner.

Another aspect of the present invention is to provide a roll blind having a bidirectional clutch unit, rollers of which are adapted to grasp the driving shaft of the winding rod and rotate it forwards/backwards so that the blind material is raised/lowered without generating unpleasant noise that would otherwise compromise the quietness of indoor environment.

Technical solution

In accordance with an aspect of the present invention, there is provided a roll blind having a noiseless bidirectional clutch to wind a blind material around a winding rod for storage or unwind the blind material down from the winding rod for use, the roll blind including: a safety cord connected to and wound around a chain pulley adapted to rotate the winding rod, the safety cord having a separated lower end so that one side defines a lowering cord for pulling down the blind material and the other side defines a raising cord for rolling up the blind material; a bidirectional clutch unit adapted to raise/lower the blind material, the bidirectional clutch unit being positioned between the chain pulley and a driving shaft of the winding rod, the bidirectional clutch unit having bidirectional protrusions formed on an inner peripheral surface of the chain pulley at an identical interval in a circumferential direction so that, when the lowering or raising cord is pulled, the winding rod rotates together with the chain pulley, the bidirectional clutch unit having a number of rollers positioned between respective bidirectional protrusions on an outer peripheral surface of the driving shaft of the winding rod at an identical interval in the circumferential direction; and a return operation unit having an elastic restoration member adapted to accumulate elastic restoration force, when pulling of the lowering or raising cord rotates the chain pulley, through a return pulley rotating together with the chain pulley, the return pulley rotating the chain pulley backwards around the driving shaft of the winding rod, when the lowering or raising cord is released from the pulled condition, using the elastic restoration force accumulated in the elastic restoration member so that, without displacement of the blind material, the safety cord returns to the original position.

Advantageous Effects

A roll blind according to the present invention has a pulling cord for raising/lowering the blind material, the lower end of the cord being separated to reduce its length so that, even if the blind is positioned high beyond the reach of children, the blind material can be raised/lowered smoothly, thereby preventing any negligent accident (e.g. the cord being wound around the neck of a child) during use of the blind.

Furthermore, once either the lowering or raising cord is pulled down through the bidirectional clutch, the cord returns smoothly to the original position, thereby guaranteeing that the user can easily use the lowering or raising cord to continuously raise/lower the blind material in a convenient manner.

In addition, through the operation process, rollers of the bidirectional clutch unit grasp the driving shaft of the winding rod to rotate it forwards/backwards so that the blind material is raised/lowered without generating unpleasant noise that would otherwise compromise the quietness of indoor environment.

MODE FOR INVENTION

An exemplary embodiment of the present invention will now be described in more detail with reference to the accompanying drawings.

Figure 1:
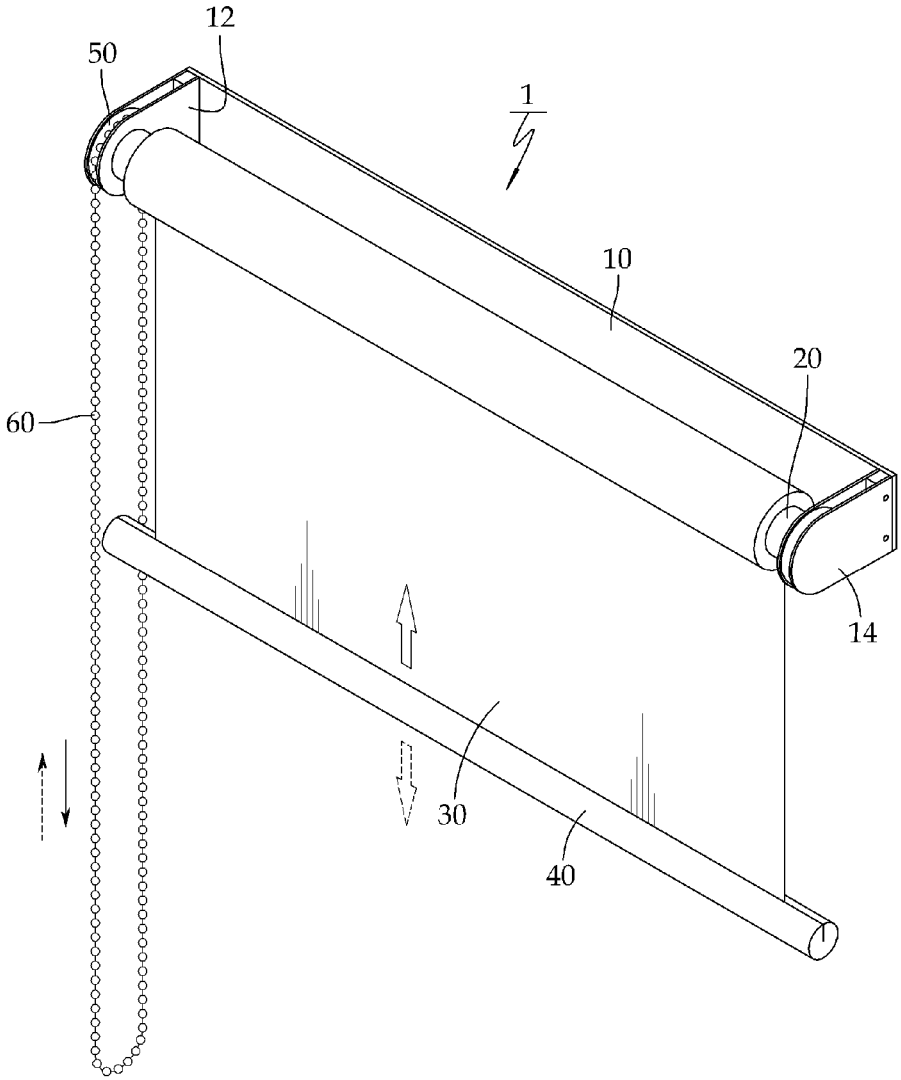
FIG. 1 is a perspective view of a conventional roll blind.
Figure 2:
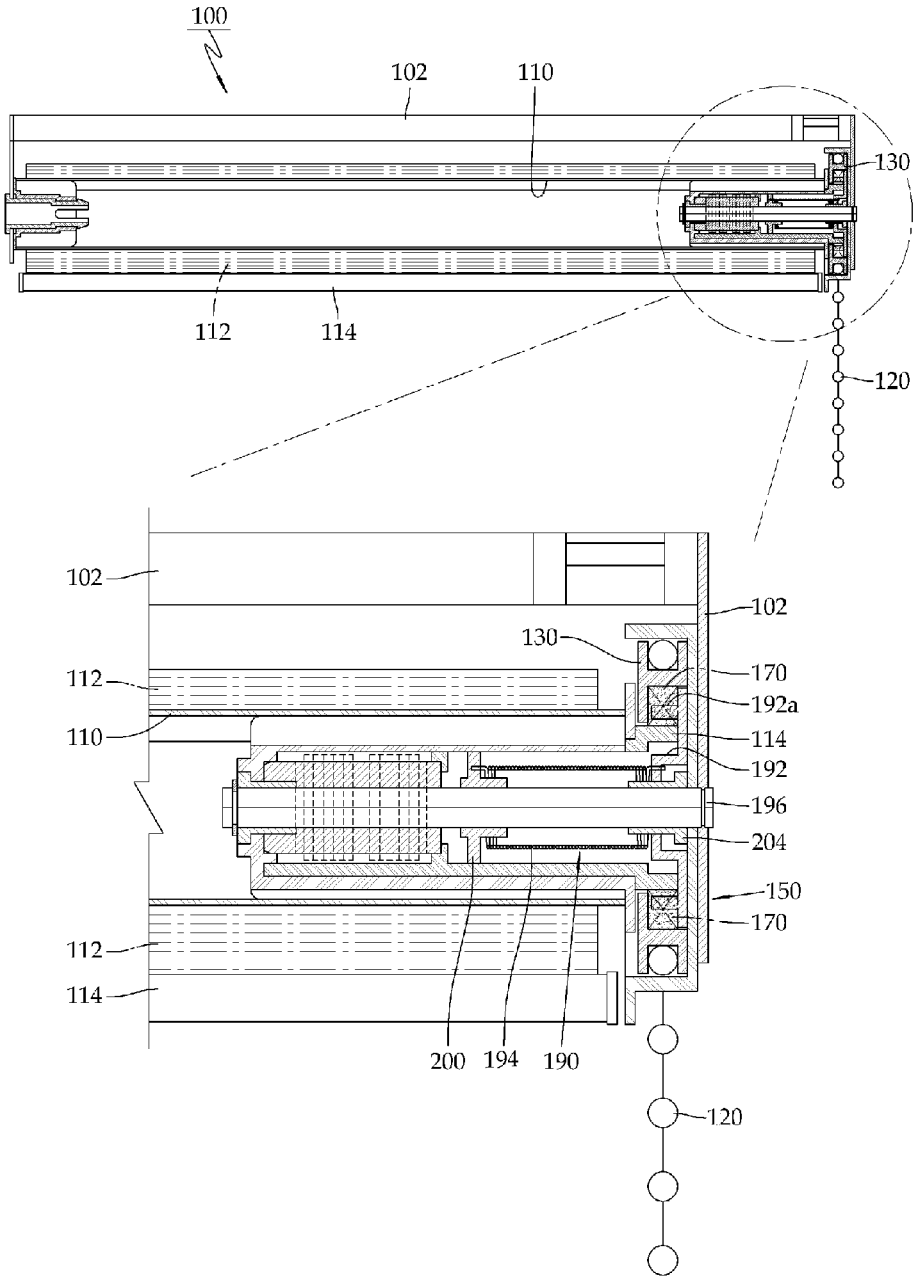
FIG. 2 is a front sectional view of a roll blind having a noiseless bidirectional clutch according to the present invention.
Figure 3:
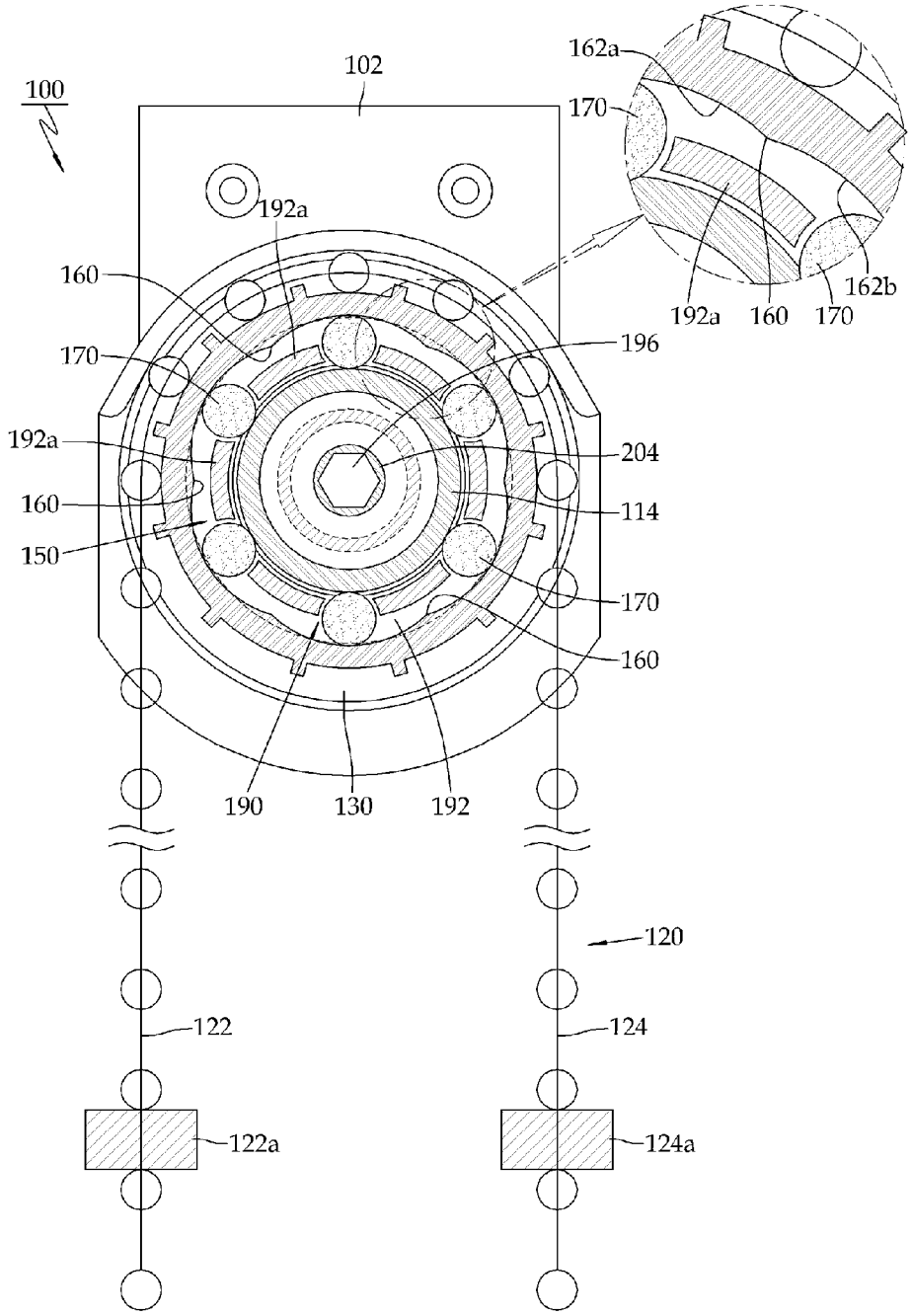
FIG. 3 is a detailed lateral sectional view of a roll blind having a noiseless bidirectional clutch according to the present invention.

A roll blind 100 having a noiseless bidirectional clutch according to the present invention, as shown in FIGS. 2 and 3, has the following construction: a blind material 112 is stored and wound around a winding rod 110 inside a bracket 102, and a weight 114 is connected to the lower end of the blind material 112, as in the case of the prior art, to pull down the blind material 112 by its own weight.

The roll blind 100 having a safety cord 120 according to the present invention has a safety cord 120, the lower end of which is separated, to rotate the winding rod 110. Specifically, the middle portion of the safety cord 120 is connected to and wound around a chain pulley 130 adapted to rotate the winding rod 110. The lower end of the safety cord 120 is separated so that one side thereof defines a lowering cord 122 for pulling down the blind material 112, and the other side thereof defines a raising cord 124 for rolling up the blind material 112.

The safety cord 120 is preferably a chain cord, which is coupled to the chain pulley 130 to rotate the chain pulley 130 forwards or backwards as the lowering cord 122 on the back side or the raising cord 124 on the front side is pulled.

The lowering and raising cords 122 and 124 have handles 122*a* and 124*a* fixed to their lower ends, respectively, so that the lowering and raising cords 122 and 124 engage with the chain pulley 130 without passing it. The handles 122*a* and 124*a* are, for example, clip members having a diameter larger than that of the safety cord 120 and are configured so that their height relative to the lowering and raising cords 122 and 124 can be adjusted. That is, the handles 122*a* and 124*a* make it possible to adjust the pulling length of the lowering and raising cords 122 and 124.

The roll blind 100 having a noiseless bidirectional clutch according to the present invention has a bidirectional clutch unit 150 adapted to transmit power between the chain pulley 130 and the driving shaft 114 of the winding rod 110 to raise/lower the blind material 112.

The bidirectional clutch unit 150 is configured to transmit power, as the lowering or raising cord 122 or 124 is pulled, so that the winding rod 110 is rotated together with the chain pulley 130.

The bidirectional clutch unit 150 includes bidirectional protrusions 160 formed on the inner peripheral surface of the chain pulley 130 at an identical interval in the circumferential direction and a number of rollers 170 positioned between respective bidirectional protrusions 160 on the outer peripheral surface of the driving shaft 114 of the winding rod 110 at an identical interval in the circumferential direction.

Specifically, the bidirectional clutch unit 150 includes, as magnified in FIG. 3, six bidirectional protrusions 160 formed on the inner peripheral surface of the chain pulley 130 at an identical interval in the circumferential direction and six rollers 170 positioned between the bidirectional rollers 160.

As will be described later in more detail, six arcuate engagement members 192*a* protrude from one side of a return pulley 192 of a return operation unit 190 and are positioned at an identical interval in the circumferential direction so as to correspond to the bidirectional protrusions 160.

The rollers 170 of the bidirectional clutch unit 150 are positioned between respective arcuate engagement members 192*a* protruding from one side of the return pulley 192.

Figure 4:
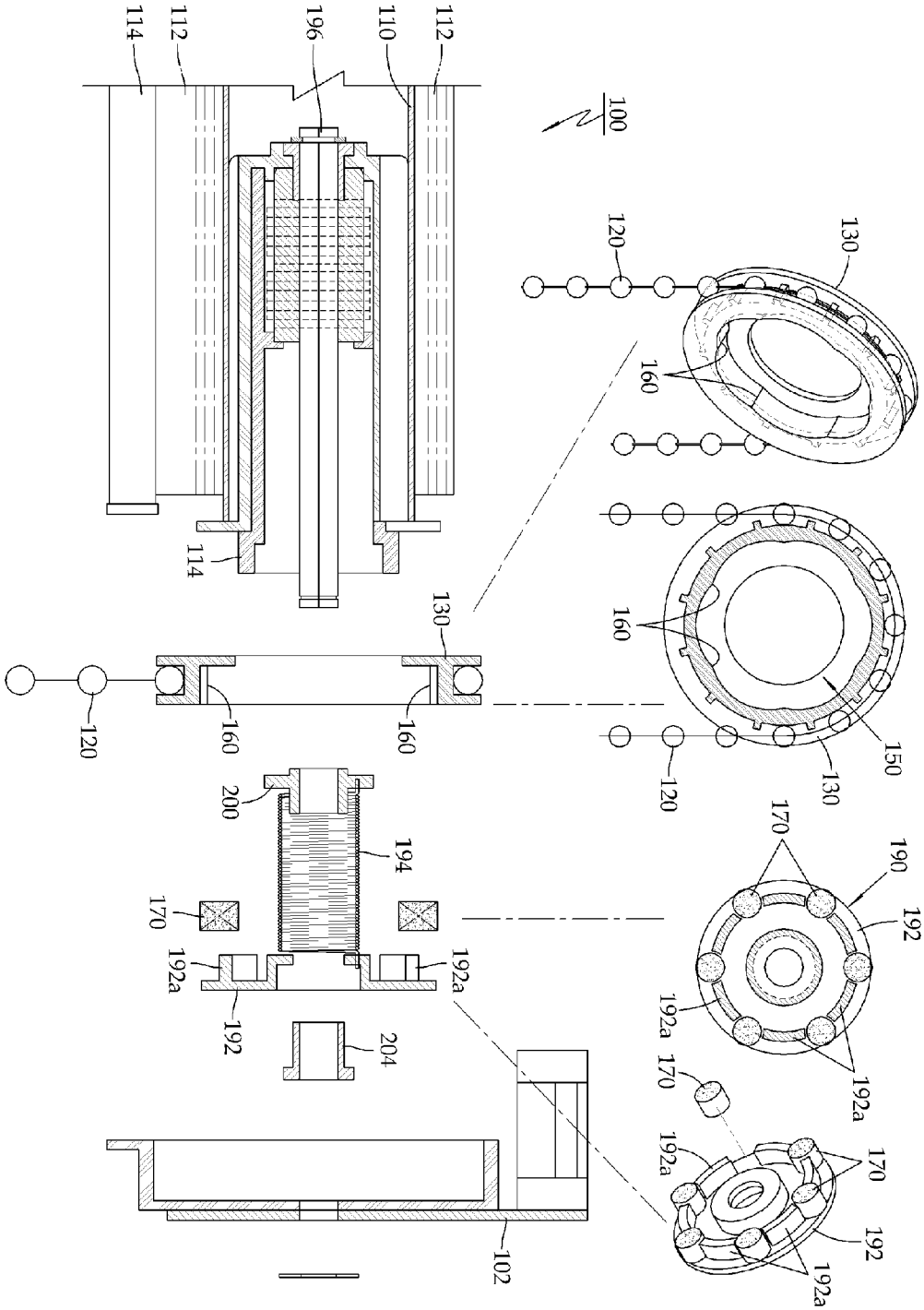
FIG. 4 is an exploded/assembled view of a roll blind having a noiseless bidirectional clutch according to the present invention.

The structure of the bidirectional clutch unit 150 is illustrated in the exploded view of FIG. 4.

Referring to the drawing, the chain pulley 130 has six bidirectional protrusions 160 formed on its inner surface at an identical interval in the circumferential direction, and six rollers 170 are arranged between the inner peripheral surface of the chain pulley 130 and the outer peripheral surface of the driving shaft 114 of the winding rod 110, which is fitted onto the inner peripheral surface, at an identical interval in the circumferential direction.

The return pulley 192 of the return operation unit 190 is fastened to an end of the driving shaft 114 of the winding rod 110, as shown in the lateral sectional view of FIG. 2, and respective rollers 170 are arranged between six arcuate engagement members 192*a* provided on the return pulley 192*a* of the return operation unit 190.

The rollers 170 have, as shown in FIG. 4, a cylindrical shape.

The roll blind 100 having a noiseless bidirectional clutch according to the present invention further includes a return operation unit 190 configured to rotate the chain pulley 130 backwards around the driving shaft 114 of the winding rod 110, when the lowering or raising cord 122 or 124 is pulled, to return the safety cord 120 to the original position with no displacement of the blind material 112.

The return operation unit 190 has an elastic restoration member 194 configured to accumulate elastic restoration force through the return pulley 192, which rotates together with the chain pulley 130 when pulling of the lowering or raising cord 122 or 124 rotates the chain pulley 130.

The elastic restoration member 194, as shown in FIGS. 2 and 4, consists of a coil spring wound around a hexagonal center shaft 196 inside the driving shaft 114 of the winding rod 110. The driving shaft 114 of the winding rod 110 is positioned around the hexagonal center shaft 196, an end of which is fixed to the bracket 102.

The elastic restoration member 194, i.e. coil spring, has one side connected to a stopper 200 fitted and fixed to the hexagonal center shaft 196 and the other side connected to one side of the return pulley 192.

The return pulley 192 has an inner peripheral surface rotatably mounted on the hexagonal center shaft 196 through a cylindrical sleeve 204 and an outer peripheral surface positioned inside the inner peripheral surface of the chain pulley 130 so that, when the chain pulley 130 rotates, the return pulley 192 rotates together with it through the cylindrical sleeve 204 and accumulates elastic restoration force in the coil spring.

The return operation unit 190 is configured so that, when the lowering or raising cord 122 or 124 is released from the pulled condition, the elastic restoration force accumulated in the elastic restoration member 194 is used by the return pulley 192 to rotate the chain pulley 130 backwards around the driving shaft 114 of the winding rod 110, thereby guaranteeing that the safety cord 120 returns to the original position with no displacement of the blind material 112.

The roll blind 100 having a noiseless bidirectional clutch according to the present invention, which has the above-mentioned construction, operates as follows: the safety cord 120, the lower end of which is separated, is positioned high beyond the reach of children. The user pulls the lowering or raising cord 122 or 124 and returns it to the original position using the return operation unit 190. In this manner, the height of the blind material 112 can be adjusted continuously.

Figure 5:
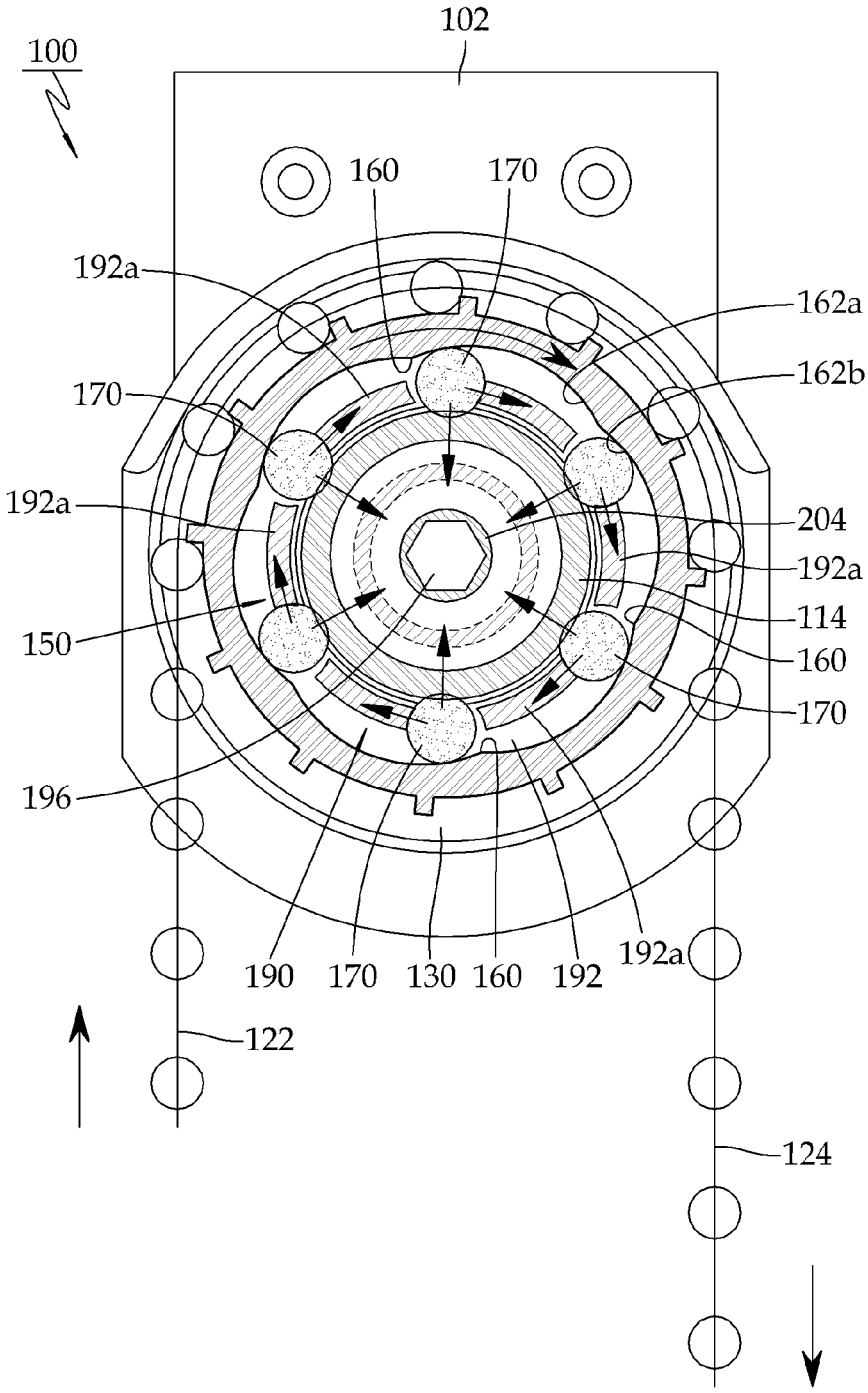
FIG. 5 illustrates an operation of accumulating elastic restoration force, when the blind material is lowered, by a roll blind having a noiseless bidirectional clutch according to the present invention.

More specifically, referring to FIG. 5, the lowering cord 122 is pulled down to rotate the chain pulley 130 forwards. The bidirectional protrusions 160 then force the rollers 170 against the arcuate engagement members 192*a* of the return pulley 192, respectively, and rotate the return pulley 192 forwards.

At the same time, the rollers 170 are pressurized towards the center of the driving shaft 114 of the winding rod 110, so that the rollers 170 on the inside grasp the driving shaft 114 of the winding rod 110 and rotate it forwards together with the chain pulley 130. As a result, the winding rod 110 rotates and lowers the blind material 112.

Respective bidirectional protrusions 160 of the bidirectional clutch unit 150 have front and rear slanted surfaces 162*a* and 162*b*, which are slanted in both directions from the inner peripheral surface of the chain pulley 130, respectively. The rear slanted surfaces 162*b* of the front and rear slanted surfaces 162*a* and 162*b*, in this case, are forced against the upper portions of the rollers 170, respectively.

That is, pulling of the lowering cord 122 forces the rear slanted surfaces 162*b* of the bidirectional protrusions 160 against corresponding rollers 170. The rear slanted surfaces 162*b* then grasp the driving shaft 114 of the winding rod 110 and rotate the driving shaft 114 forwards together with the chain pulley 130 so that the blind material 112 is lowered.

Such forward rotation of the chain pulley 130 increases the length of the lowering cord 122, which has been pulled down by the user, compared with that of the raising cord 124, which is then positioned higher. The lowering cord 122 is then raised automatically by the return operation unit 190.

In other words, forward rotation of the chain pulley 130 causes the bidirectional protrusions 160 to force the rollers 170 against the arcuate engagement members 192*a* of the return pulley 192, which then rotates forwards.

The inner peripheral surface of the return pulley 192 rotates forwards around the hexagonal center shaft 196 through the cylindrical sleeve 204 so that elastic restoration force is accumulated in the coil spring.

If the lowering cord 122 is released from the pulled condition, the elastic restoration force accumulated in the coil spring is used by the return pulley 192 to rotate the chain pulley 130 backwards around the driving shaft 114 of the winding rod 110.

Figure 6:
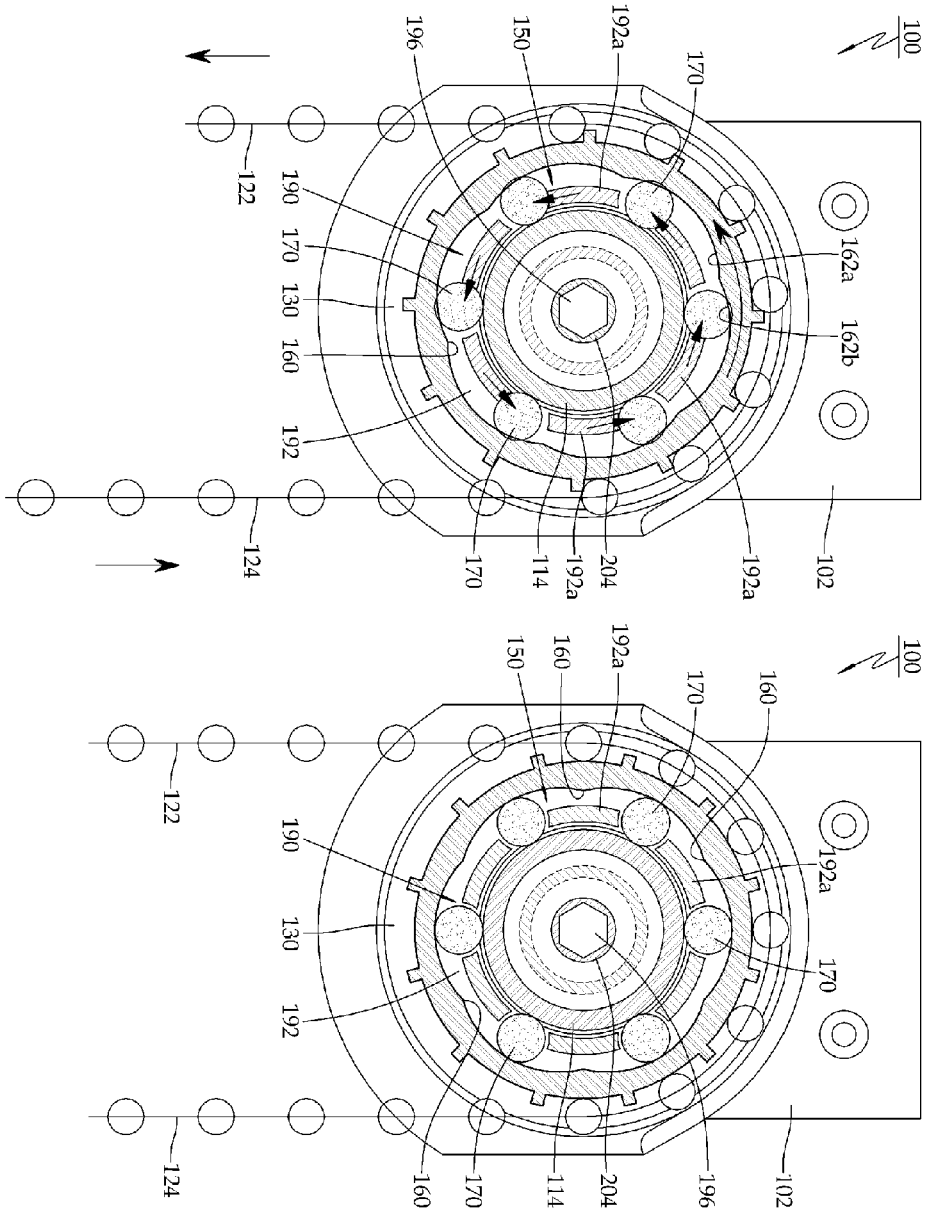
FIG. 6*a* illustrates an operation of returning the safety cord to the original position, without moving the blind material, by a roll blind having a noiseless bidirectional clutch according to the present invention.
FIG. 6*b* illustrates an operation of returning the safety cord to the initial position by a roll blind having a noiseless bidirectional clutch according to the present invention.

During such backward rotation, as shown in FIG. 6*a*, the rollers 170 do not pressurize the driving shaft 114 of the winding rod 110 to grasp them, contrary to the case of forward rotation of the chain pulley 130, but push the rear slanted surfaces 162*b* of the chain pulley 130 backwards and rotate only the chain pulley 130 backwards.

That is, the chain pulley 130 rotates backwards, while the driving shaft 114 of the winding rod 110 does not, so that, with no upward movement of the blind material 112, the lowering cord 122 is raised only through the chain pulley 130, and the raising cord 124 lowered.

As a result, as shown in FIG. 6*b*, the lowering cord 122 rises, and the raising cord 124 descends and automatically returns to the original position.

If the lowering cord 122 is pulled again in this state, the rear slanted surfaces 162*b* of the bidirectional protrusions 160 are again forced against the rollers 170 to grasp the driving shaft 114 of the winding rod 110 and rotate it forwards together with the chain pulley 130, thereby lowering the blind material 112 again.

The additional forward rotation of the chain pulley 130 increases the length of the lowering cord 122, which has been pulled down by the user, compared with that of the raising cord 124, which is then positioned higher. The lowering cord 122 is then raised again automatically by the return operation unit 190.

As such, the user pulls down the lowering cord 122 to lower the blind material 112 by a predetermined length, and then releases the pulled lowering cord 122, which then returns to the original position. The user again pulls the lower cord 122 and returns it to the original position. This process is repeated until the blind material 112 is lowered to have a desired length.

When the user wants to return the lowered blind material 112 to the initial condition, he/she pulls the raising cord 124 on the front side.

Figure 7:
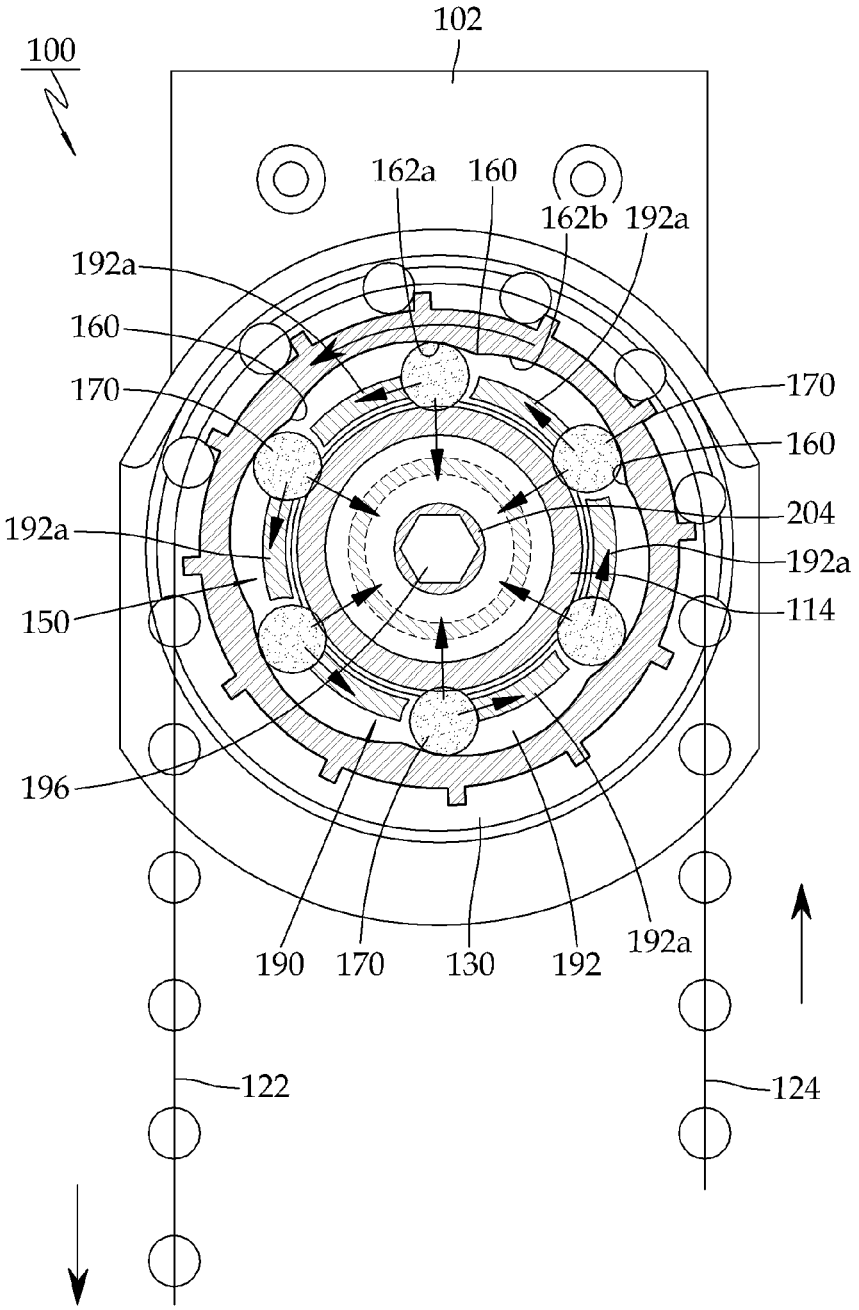
FIG. 7 illustrates an operation of accumulating elastic restoration force, when the blind material is raised, by a roll blind having a noiseless bidirectional clutch according to the present invention.

Specifically, as shown in FIG. 7, pulling of the raising cord 124 forces the front slanted surfaces 162*a* of the bidirectional protrusions 160 against corresponding rollers 170. The front slanted surfaces 162*a* then grasp the driving shaft 114 of the winding rod 110 and rotate it backwards together with the chain pulley 130 to raise the blind material 112.

Such backward rotation of the chain pulley 130 increases the length of the raising cord 124, which has been pulled down by the user, compared with that of the lowering cord 122, which is then positioned higher. The raising cord 124 is then raised to the original position automatically by the return operation unit 190.

In other words, backward rotation of the chain pulley 130 causes the front slanted surfaces 162*a* of the bidirectional protrusions 160 to force the rollers 170 against the arcuate engagement members 192*a* of the return pulley 192, which then rotates backwards.

The inner peripheral surface of the return pulley 192 rotates backwards around the hexagonal center shaft 196 through the cylindrical sleeve 204 so that elastic restoration force is accumulated in the coil spring.

The coil spring is twisted in the opposite direction to the forward rotation of the return pulley 192 and accumulates elastic restoration force in the opposite direction.

If the raising cord 124 is released from the pulled condition, the elastic restoration force accumulated in the coil spring is used by the return pulley 192 to rotate the chain pulley 130 forwards around the driving shaft 114 of the winding rod 110.

During such forward rotation, the rollers 170 do not pressurize the driving shaft 114 of the winding rod 110 to grasp them, but push only the front slanted surfaces 162*a* of the chain pulley 130 forwards and rotate only the chain pulley 130 forwards.

That is, the chain pulley 130 rotates forwards, while the driving shaft 114 of the winding rod 110 does not, so that, with no upward movement of the blind material 112, the raising cord 124 is raised only through the chain pulley 130, and the lowering cord 122 lowered.

As a result, the raising cord 124 on the front rises, and the lowering cord 122 on the back descends and automatically returns to the original position.

The user can further repeat the process of pulling the raising cord 124 and releasing it, in this state, until the blind material 112 is raised to the initial position by a predetermined length.

As described above, the roll blind 100 having a noiseless bidirectional clutch according to the present invention has a pulling cord for raising/lowering the blind material 112, the lower end of the cord being separated to reduce its length so that, even if the cord is positioned high beyond the reach of children, the blind material 112 can be raised/lowered smoothly, thereby preventing any negligent accident (e.g. the cord being wound around the neck of a child) during use of the blind.

The lower end of the safety cord 120 is separated so that one side thereof defines a lowering cord 122 for pulling down the blind material 112, and the other side thereof defines a raising cord 124 for rolling up the blind material 112. The roll blind 100 according to the present invention has a bidirectional clutch unit 150 configured so that, when the lowering or raising cord 122 or 124 is pulled, the winding rod 110 rotates together with the chain pulley 130 to raise/lower the blind material 112. The roll blind 100 also includes a return operation unit 190 configured so that, once the lowering or raising cord 122 or 124 is released from the pulled condition, the safety cord 120 returns to the original position with no displacement of the blind material 112.

According to the present invention, once either the lowering or raising cord 122 or 124 is pulled down through the bidirectional clutch, the cord automatically returns smoothly to the original position by means of the return operation unit 190, thereby guaranteeing that the user can easily use the lowering or raising cord 122 or 124 to continuously raise/lower the blind material 112 in a convenient manner.

In addition, the rollers 170 of the bidirectional clutch unit 50 grasp the driving shaft 114 of the winding rod 110 and rotate it forwards/backwards, during the above-mentioned operation process, so that the blind material 112 is raised/lowered without generating unpleasant noise (e.g. tinkling or rattling) that would otherwise compromise the quietness of indoor environment.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

The invention claimed is:

1. A roll blind having a noiseless bidirectional clutch to wind a blind material around a winding rod for storage or unwind the blind material down from the winding rod for use, the roll blind comprising:

a safety cord connected to and wound around a chain pulley adapted to rotate the winding rod, the safety cord having a separated lower end so that one side defines a lowering cord for pulling down the blind material and the other side defines a raising cord for rolling up the blind material;

a bidirectional clutch unit adapted to raise/lower the blind material, the bidirectional clutch unit being positioned between the chain pulley and a driving shaft of the winding rod, the bidirectional clutch unit having bidirectional protrusions formed on an inner peripheral surface of the chain pulley at an identical interval in a circumferential direction so that, when the lowering or raising cord is pulled, the winding rod rotates together with the chain pulley, the bidirectional clutch unit having a number of rollers positioned between respective bidirectional protrusions on an outer peripheral surface of the driving shaft of the winding rod at an identical interval in the circumferential direction; and a return operation unit having an elastic restoration member adapted to accumulate elastic restoration force, when pulling of the lowering or raising cord rotates the chain pulley, through a return pulley rotating together with the chain pulley, the return pulley rotating the chain pulley backwards around the driving shaft of the winding rod, when the lowering or raising cord is released from the pulled condition, using the elastic restoration force accumulated in the elastic restoration member so that, without displacement of the blind material, the safety cord returns to the original position.

2. The roll blind having a noiseless bidirectional clutch as claimed in claim 1, wherein the bidirectional clutch unit has six bidirectional protrusions formed on the inner peripheral surface of the chain pulley at an identical interval in the circumferential direction and six rollers positioned between the bidirectional protrusions, and the return pulley has six arcuate engagement members protruding from one side of the return pulley at an identical interval in the circumferential direction, the arcuate engagement members being positioned to correspond to the bidirectional protrusions.

3. The roll blind having a noiseless bidirectional clutch as claimed in claim 2, wherein the bidirectional clutch unit has a number of rollers positioned between the arcuate engagement members protruding from one side of the return pulley, respectively, so that, when the lowering or raising cord is pulled down, the chain pulley rotates, respective bidirectional protrusions force the rollers against the arcuate engagement members of the return pulley and rotate the return pulley, and, at the same time, the bidirectional protrusions pressurize the rollers towards the center of the driving shaft of the winding rod so that the rollers grasp the driving shaft of the winding rod on the inside to rotate the driving shaft together with the chain pulley and thus raise/lower the blind material.

4. The roll blind having a noiseless bidirectional clutch as claimed in claim 3, wherein respective bidirectional protrusions of the bidirectional clutch unit have front and rear slanted surfaces slanted from the inner peripheral surface of the chain pulley in both directions, respectively, and the front and rear slanted surfaces are forced against upper portions of respective rollers, when the chain pulley rotates, so that, when the lowering cord is pulled down, respective rear slanted surfaces of the bidirectional protrusions are forced against the rollers, grasp the driving shaft of the winding rod, and rotate the driving shaft forwards together with the chain pulley to lower the blind material, and, when the raising cord is pulled, respective front slanted surfaces of the bidirectional protrusions are forced against the rollers, grasp the driving shaft of the winding rod, and rotate the driving shaft backwards together with the chain pulley to raise the blind material.

5. The roll blind having a noiseless bidirectional clutch as claimed in claim 1, wherein the elastic restoration member of the return operation unit consists of a coil spring wound around a hexagonal center shaft inside the driving shaft of the winding rod, the hexagonal center shaft has one side fixed to a bracket, the coil spring has one side connected to a stopper fitted and fixed to the hexagonal center shaft, and the other side of the coil spring is connected to one side of the return pulley so that, when the chain pulley rotates and accumulates elastic restoration force in the coil spring, the accumulated elastic restoration force is used to rotate the return pulley backwards and rotate the chain pulley backwards to return the safety cord to the original position.

6. The roll blind having a noiseless bidirectional clutch as claimed in claim 5, wherein the return pulley has an inner peripheral surface rotatably mounted on the hexagonal center shaft through a cylindrical sleeve and an outer peripheral surface rotatably positioned inside the inner peripheral surface of the chain pulley.

7. The roll blind having a noiseless bidirectional clutch as claimed in claim 2, wherein the rollers have a cylindrical shape.

* * * * *